United States Patent [19]

Gillis et al.

[11] 4,263,885

[45] Apr. 28, 1981

[54] WOODBURNING STOVE

[76] Inventors: Gordon A. Gillis, 18 Royal Lake Dr., Braintree, Mass. 02184; Richard D. Lucier, 610 N. Cary St., Brockton, Mass. 02402

[21] Appl. No.: 9,405

[22] Filed: Feb. 5, 1979

[51] Int. Cl.[3] ..... F24M 9/00

[52] U.S. Cl. ..... 126/60; 126/200; 220/213; 220/346

[58] Field of Search ..... 126/60–66, 126/200, 110 B, 120, 77; 220/213, 345, 346

[56] References Cited

U.S. PATENT DOCUMENTS

| | | | |
|---|---|---|---|
| 2,120,167 | 6/1938 | Waream | 220/213 |
| 3,757,766 | 9/1973 | Stevenson | 126/60 |
| 4,136,662 | 1/1979 | Willson | 126/61 |
| 4,140,101 | 2/1979 | Glover | 126/61 X |

*Primary Examiner*—George T. Hall
*Attorney, Agent, or Firm*—Wolf, Greenfield & Sacks

[57] ABSTRACT

The stove is of the cylindrical firechamber-type having a side loading door for loading wood or other combustible material such as coke or coal into the chamber. The front of the stove chamber may be opened to enable viewing of the wood burning in the stove by means of an arcuate sliding door that is operable to substantially totally close the chamber or open a section of the front thereof for viewing purposes. The sliding door is covered by a shield (window) construction including a tempered glass face. The stove is provided with an open base for supporting the chamber and a shroud covering the top and back of the chamber and preferably having blower means associated therewith. The drafting of the chamber is provided by a side door draft and a top draft extending longitudinally of the chamber.

16 Claims, 7 Drawing Figures

WOODBURNING STOVE

BACKGROUND OF THE INVENTION

The present invention relates in general to woodburning heaters or stoves which are primarily adapted for the burning of wood but may also be used for the burning of other combustible material such as coal or coke. This invention pertains, more particularly, to a stove construction of the cylindrical firechamber type which has the dual purpose use of a heating stove and a form of fireplace enabling a viewing of the woodburning process.

Typical prior art patents that relate to the general field of the present invention include U.S. Pat. Nos. 3,757,766 and 3,986,488; and French Pat. Nos. 513,859 and 1,246,864. Some of the disadvantages associated with these prior art constructions are the complexity of the design, the ineffective operability of the stove, the inefficiency of the design, and the lack of a proper drafting system.

Accordingly, one object of the present invention is to provide an improved stove construction preferably for burning wood but also provided with a front window through which the fire in the firechamber may be viewed.

A further object of the present invention is to provide an improved cylindrical firechamber type stove providing in association with a tempered glass window at the front of the stove, an arcuate sliding door that may be opened for viewing purposes of the burning fire.

Still another object of the present invention is to provide an improved drafting system so as to enhance combustion and provide substantially complete burning of the combustible material.

A further object of the present invention is to provide a woodburning stove having an improved top shroud construction for directing heated air and also functioning as a table top upon which items can be heated.

Another object of the present invention is to provide an improved woodburning stove that preferably has a lining of fire brick to retain heat and prevent damage to the stove caused by hot coals.

Still another object of the present invention is to provide an improved stove construction having a shroud associated therewith with blower means in turn with the shroud for accelerating the heat recycling process so that the blown air is essentially cycled about a major circumference of the stove.

SUMMARY OF THE INVENTION

To accomplish the foregoing and other objects of this invention there is provided a stove or heater for the burning of wood or like combustible materials. This stove comprises means defining a firechamber with support means under the firechamber for supporting it above a resting surface. The firechamber is preferably constructed of a cylindrical firebox having means forming at least a front opening and a side opening of the firebox. A side door is provided adapted to be opened for feeding wood or the like into the firechamber or closed to substantially seal the side opening. Preferably, the side door is hingedly supported adjacent the side opening in the firechamber. The stove of the present invention in addition to strict use as solely a woodburning stove, also is useable, in a sense, as a fireplace and thus is provided with a front door and associated support means therefor permitting the front door to slide relative to the firebox to cover and uncover the front opening therein. Means are provided for controlling the position of the front door so as to be open in one position permitting viewing through the front opening and closed in another position substantially sealing the front door opening. In a preferred embodiment of the present invention the firechamber is preferably formed by a substantially cylindrical firebox and the front door comprises a cyclindrical segment having a like radius to that of the cylindrical firebox. The front door slides in channels connected to the firebox and in a preferred embodiment the door is maintained in an up position by a locking or holding means in an open position of the door and is rotated downwardly to a closed position substantially sealing the front opening. The stove preferably also includes a front window housing covering the front opening and including a heat-proof window supported in the housing spaced forwardly of the front opening. The control means for the front door is operable from the outside of the firebox and window housing.

In accordance with the present invention there are preferably provided both a first draft means associated with the side door and a second draft means disposed at a top portion of the firechamber. The upper arranged draft means is preferably disposed longitudinally of the firebox. The draft system of this invention provides an extremely efficient burning of the combustible material.

In accordance with another important feature of the present invention there is provided a shroud means disposed over a portion of the outer surface of the firechamber forming a duct for the passage of air to be warmed by passing adjacent the firechamber wall. The shroud means preferably has a flat top forming a table-like surface upon which objects may be supported for heating thereof. The shroud means preferably extends about a top section and a back section of the firechamber and has blower means associated therewith for forcing air through the shroud, the air being heated as it passes therethrough. Also, the support base for the chamber is preferably open permitting further air circulation about a major perimeter of the firechamber.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
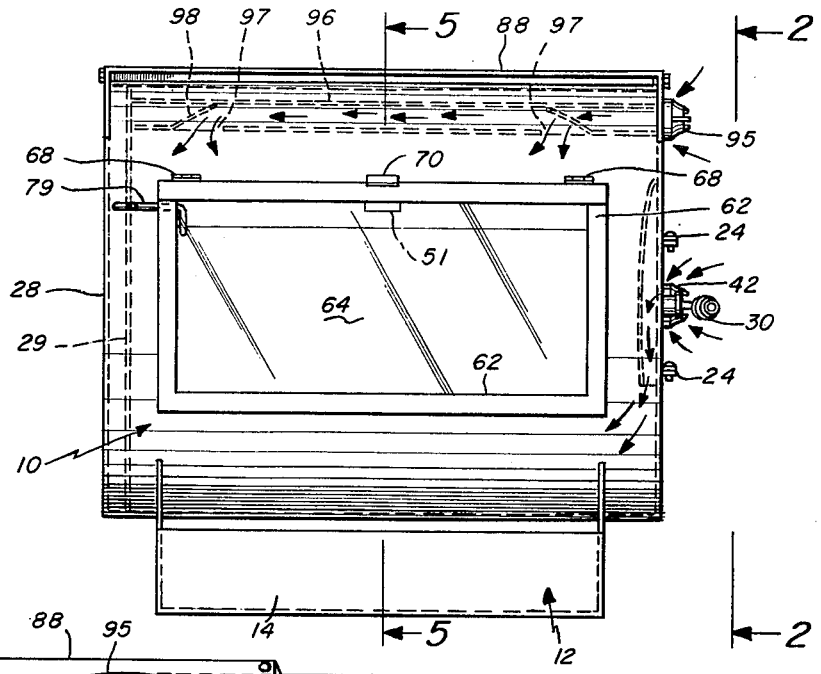
FIG. 1 is a front elevation of a preferred embodiment of the stove of this invention.
Figure 5:
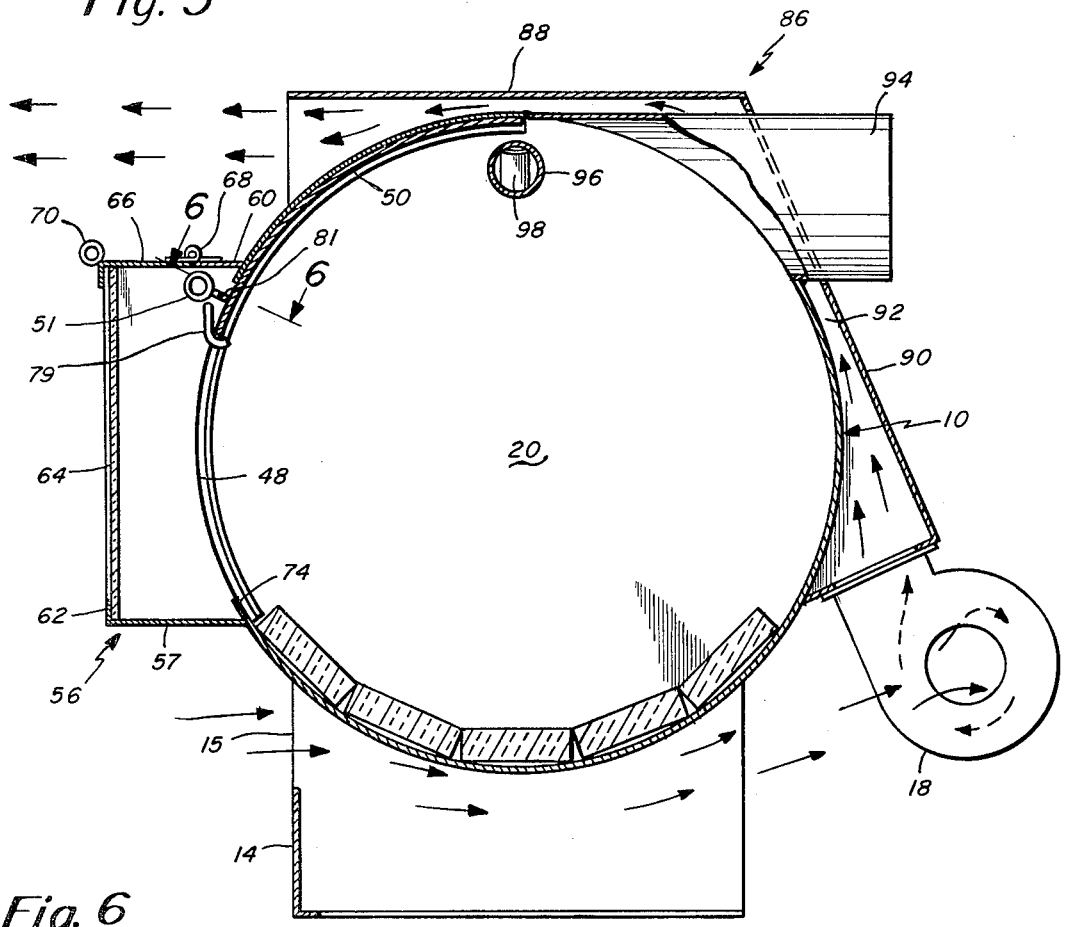
FIG. 5 is a cross-sectional view taken along line 5—5 of FIG. 1 showing further detail of the firechamber or firebox construction and the paths of air circulation thereabout.

Referring now to the drawings there is shown one embodiment of the present invention comprising a cylindrical firebox 10 supported from base 12 having a front upright wall 14 as depicted in FIGS. 1 and 5. The cylindrical firebox 10 is preferably constructed of high quality steel and the base 12 may be secured to the firebox by means of welding. The upright wall 14 forms an opening 15 for air circulation through the base 12; the air being drawn therethrough by means of the blower 18 discussed in further detail hereinafter. FIG. 5 shows the air circulation by arrows leading through the base toward the blower 18.

Figure 2:
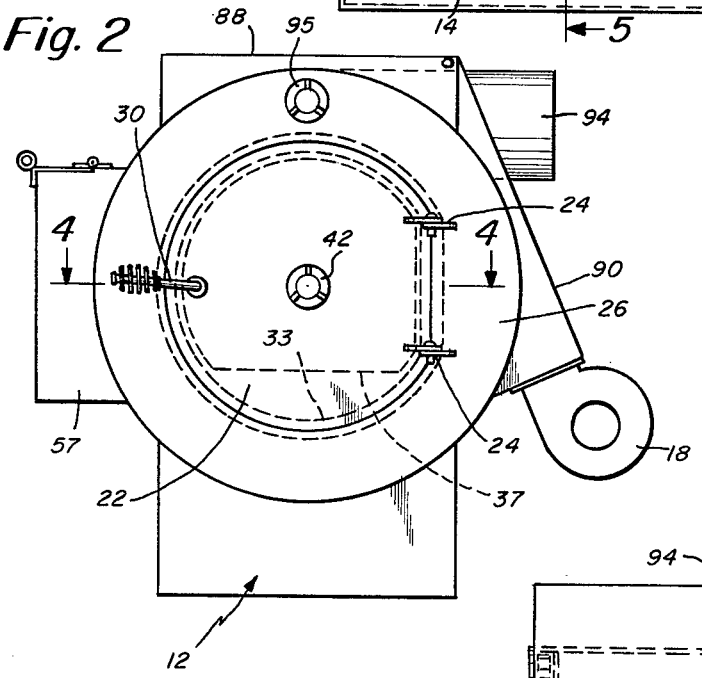
FIG. 2 is a side elevation view as taken along line 2—2 of FIG. 1 showing the side loading door.

The cylindrical firebox 10 defines an inner cylindrical firechamber 20 into which the wood or other material may be loaded through the end or side door 22 secured by means of hinges 24 from the end wall 26. The opposite end of the chamber is sealed totally by an opposite end wall 28. The construction of the side door 22 is shown in FIGS. 2 and in a cross-section of FIG. 4. As previously mentioned, the door 22 is hinged at 24 to the wall 26 and is provided with a handle 30 for opening and closing the door. An L-shaped channel 32 extends about the periphery of the opening in the end wall 26. The channel 32 has a leg 33 extending inwardly to define a surface against which the door 22 flushly closes, assuming the position shown in FIG. 4 when in a fully closed position. The handle 30 is also constructed with an outer end and a turned inner end 34 which is adapted to lock with the channel 32 as depicted in FIG. 4.

Figure 4:
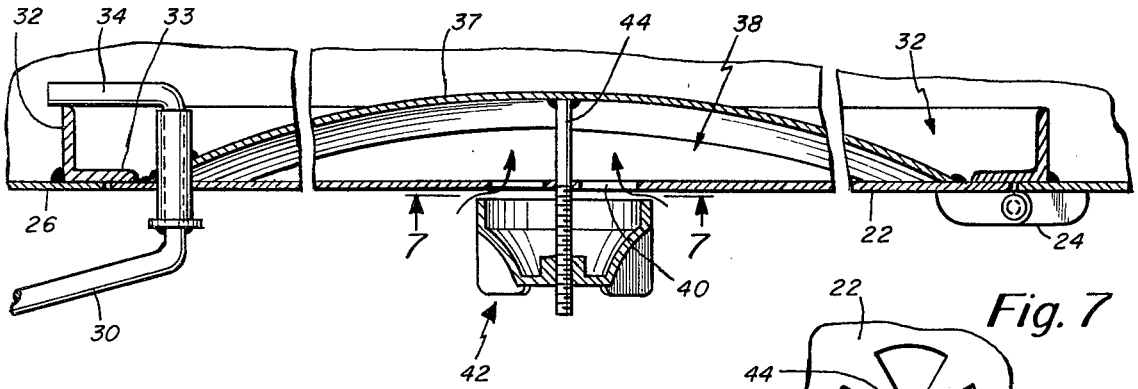
FIG. 4 is a cross-sectional view taken along line 4—4 of FIG. 2 showing further details of the loading door construction.
Figure 7:
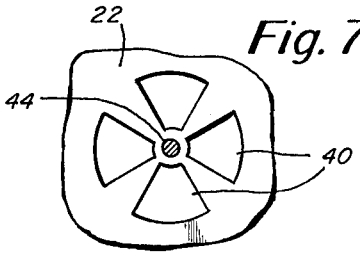
FIG. 7 is a cross-sectional view taken along line 7—7 of FIG. 4.

As depicted in FIG. 4, there is provided a curved baffle plate 37 which is secured at its ends to the interior surface of the door 22. This plate 37 along with the door 22 defines an air baffle chamber 38. This chamber 38 is open at its top and bottom so that air entering through the openings 40 depicted in FIGS. 4 and 7 enter the chamber 38 and from there progress into the main chamber 20. FIG. 7 clearly shows the four openings 40 diametrically disposed. The draft through the openings 40 is controlled by the door spin draft 42 which is threadedly engaged with the threaded rod 44. The rod 44 is free at its threaded end and is welded at its other end to the center of the baffle 37 as depicted in FIG. 4. The draft 42 may be rotated clockwise as viewed in FIG. 2 to reduce the draft and alternatively counter clockwise to increase the draft.

Figure 6:
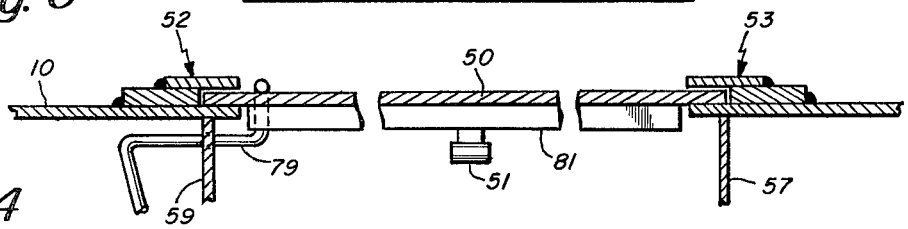
FIG. 6 is a cross-sectional view taken along line 6—6 of FIG. 5.

In addition to the opening provided for the side door 22, there is also provided a second front opening 48 which is of generally rectangular shape and which may be covered by the arcuate sliding door 50. The door 50 is shown in FIG. 5 in its fully open position. As depicted in FIG. 6 there are a pair of elongated members 52 and 53 which define a channel on opposite sides of the door 50 for guiding the door 50 in an arcuate manner to open and close the opening 48, shown in FIG. 5. The members 52 and 53 may each be formed by a pair of arcuately-shaped plates each fixed together and welded to the interior surface of the firebox 10. Each member 52, 53 is disposed adjacent the opening 48 and the members are spaced the appropriate distance to receive the arcuate door 50 leaving sufficient clearance to permits its easy sliding movement in the channel members.

When the door 50 is open as depicted in FIG. 5 in accordance with the invention there is also provided a window housing 56 comprised of a plurality of walls forming a box and extending about the opening 48. The housing 56 comprises a bottom wall 57, side walls 57 and 59 and a top wall 60. The side walls and the bottomm wall terminate in a flange 62 extending about 3 sides of the housing and for partially supporting the tempered glass plate 64. On the inner side of the plate 64 there may also be provided ridges or the like extending from the walls for maintaining the plate in one predetermined vertical position. To provide access into the interior of the housing, there is also provided a flap 66 hinged at 68 from the top wall 60. A knob 70 may be provided at the front of the flap 66 to facilitate the lifting thereof about hinges 68 to provide some access into the inside of the window housing 56. When the flap 66 is raised to its open position the panel 64 may easily be removed by lifting upwardly to remove it entirely from the window housing for the purpose of cleaning the panel or possibly for the replacement thereof.

In FIG. 5 the arcuate door 50 is shown in its open position. The door 50 may be moved between open and closed positions by grasping the handle 51 to move the door up or down. In the closed position, the handle 51 engages the lip 74 thus causing the door to bottom out. In the open position as depicted in FIG. 5 a locking member 79 shown in FIG. 1 may be used. The member 79 slides inwardly and may engage under an edge of the door 50 such as under the lip 81 which may extend longitudinally across the entire face of the door.

In an alternate arrangement, the handle 51 may connect to an elongated rod extending horizontally across the entire width of the window housing. This rod that connects to the handle 51 could follow an arcuate path provided by an arcuate slot in the end walls 57 and 59. Also other types of means may be provided for locking the door 50 in an open position as depicted in FIG. 5.

In the drawings there is also disclosed a shroud 86 having a flat top 88 upon which objects may rest, such as a pan for heating water or food. The shroud 86 also includes a slanted rear wall 90 and side walls forming an enclosed duct 92 through which the air passes as indicated by the arrows in FIG. 5. The blower 18 sucks the air into the duct 92. At least some of the air that is sucked into the duct passes adjacent the firebox through the open base 12. This shroud 86 is apertured to receive the outlet pipe 94 which is the exhaust from the chamber 20. The pipe 94 is of conventional diameter for connecting to lengths of stove pipe which typically connect in turn to a chimney or the like.

Figure 3:
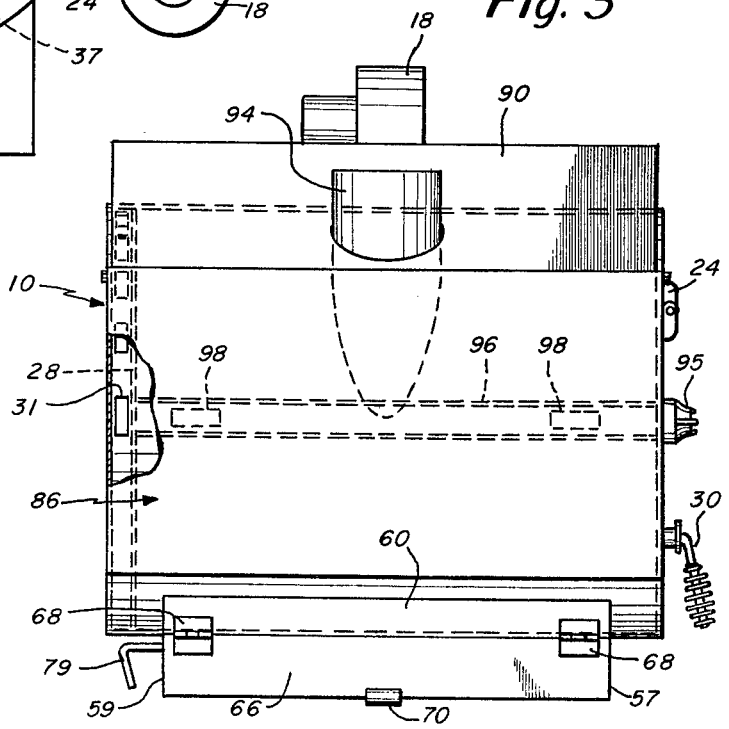
FIG. 3 is top view of the stove shown in FIGS. 1 and 2.

One of the important features of the present invention is the dual damping system which comprises, an addition to the spin draft 42, a top draft system including a second spin draft 95 which may be substantially the same as the draft member 42 shown in detail in FIG. 4. The draft member 95 may be rotated on a threaded support shaft similar to the shaft 44 shown in FIG. 4 and restricts flow in apertures associated with the member 95, these apertures being provided in the side wall 26. The draft member 95 leads to an elongated tube 96, which is preferably closed at its other end opposite the draft member 95. Apertures 97 provide the draft into the upper portion of the chamber 20. The apertures 97 are spaced along the tube 96 as depicted in FIGS. 1 and 3 and are formed by a cut-out rectangular lip 98. As depicted in FIG. 5 a draft can occur adjacent the opposite sides of the lip 98.

Among the important features of the present invention is the provision for a special shroud system that provides for optimum circulation of air to be heated about the firechamber. In this connection there is also provided an open base which provides for still further circulation of air about the firechamber. Also, the top of the shroud system has been provided as substantially flat so that an object such as a pan can be placed on top of the table surface 88 for heating food or water. Another important feature of the present invention is concerned with the easily useable slide door 50 which does not require any folding but can be simply slid between open and closed positions. Still another feature of the present invention is the efficient side door 22 which fits about a peripheral channel to provide a tight seal of the side door to the firechamber.

What is claimed is:

1. A stove for burning wood or the like comprising;

means defining a firechamber including support means therefore and means forming at least a front opening and a side opening, side door means adapted to be open for feeding wood or the like to the firechamber or closed to substantially seal said side opening and including means supporting said side door means from said firechamber means adjacent said side opening, front door means and associated support means therefore permitting said front door means to slide relative to said firechamber means to cover and uncover said front opening, and means for controlling the position of said front door means to be open in one position permitting viewing through said front opening and closed in another position substantially sealing said front opening, said firechamber being cylindrically-shaped, said front door means comprising an arcuate door and guide means for the door to permit the door to slide relative to the firechamber front opening to open and close the opening, said front door support means comprising guide means being disposed to position said arcuate door for sliding inside of the cylindrical firechamber, said means for controlling including a manually operated member operated remote from the arcuate door but engageable with a bottom end thereof for maintaining the arcuate door in an open position and disengageable therefrom to permit closing of the arcuate door.

2. A stove as set forth in claim 1 including means supported from the front of said firechamber over said front opening including a window spaced forwardly of said front opening.

3. A stove as set forth in claim 2 wherein said window comprises at least in part a tempered glass panel.

4. A stove as set forth in claim 3 wherein said control means includes means extending outwardly from the front door for hand engagement to slide the arcuate door up and down.

5. A stove as set forth in claim 1 including a window housing disposed over said front opening including a glass panel through which the fire in the firechamber can be viewed when the front door is slid open.

6. A stove as set forth in claim 5 wherein said window housing also includes a top access means to said housing interior and said front door means.

7. A stove as set forth in claim 1 including first draft means associated with said side door means and second draft means disposed at a top portion of said firechamber.

8. A stove as set forth in claim 7 wherein said draft means are both adjustable.

9. A stove as set forth in claim 1 including shroud means disposed over a portion of the outer surface of said firechamber forming a duct for passage of air to be warmed by passing adjacent the firechamber wall.

10. A stove as set forth in claim 9 wherein said shroud means has a flat top forming a table-like surface upon which objects may be supported for heating thereof.

11. A stove as set forth in claim 9 wherein said shroud means extends about a top section and back section of the firechamber, and including blower means associated with the shroud means.

12. A stove as set forth in claim 9 including blower means associated with the shroud means.

13. A stove as set forth in claim 12 wherein said firechamber support means is open permitting air circulation about a major perimeter of the firechamber, said blower means being disposed substantially between said shroud means and open support means.

14. A stove for burning wood or the like comprising;

a cylindrical firechamber having means defining a base and a front opening and side opening, a side door adapted to be opened for feeding wood or the like into the firechamber or closed to substantially seal the side opening, means supporting the side door to the firechamber adjacent the side opening, an arcuate front door and associated guide means therefor permitting the front door to slide relative to said firechamber front opening to open and close the opening, means defining a front housing covering the front opening and having a window spaced forwardly of said front opening, and means for controlling the positioning of the front door including a manually operated member supported from the front housing engageable with a bottom end of the front door for maintaining the door in an open position and disengageable therefrom to permit closing of the front door.

15. A stove as set forth in claim 14 wherein said front housing is supported by at least sidewalls thereof secured to the firechamber about the front opening with the manual control member having one end for manual engagement external of the housing and another end forming a hook for engaging the front door.

16. A stove as set forth in claim 14 wherein said guide means are disposed to position said arcuate door for sliding inside the firechamber.

* * * * *